United States Patent [19]

Ortiz

[11] Patent Number: 4,936,575

[45] Date of Patent: Jun. 26, 1990

[54] STACKED ELEMENT REMOVAL GAME INCLUDING CARDS BEARING DIFFERENT STACK PATTERNS

[76] Inventor: Emilio H. Ortiz, 42952 Parkwood St., Fremont, Calif. 94538

[21] Appl. No.: 335,320

[22] Filed: Apr. 10, 1989

[51] Int. Cl.[5] ..... A63F 9/00

[52] U.S. Cl. ..... 273/1 GG; 273/236

[58] Field of Search ..... 273/290, 288, 292, 296, 273/309, 1 GG, 276, 280, 236, 1 R

[56] References Cited

U.S. PATENT DOCUMENTS

| | | | |
|---|---|---|---|
| 227,069 | 4/1880 | Stein | 273/280 |
| 2,188,043 | 1/1940 | Harrison | 273/1 |
| 3,168,311 | 2/1965 | Sinder | 273/1 |
| 3,712,616 | 6/1973 | Goldfarb et al. | 273/1 GG |
| 4,215,858 | 8/1980 | Olsen | 273/1 R |
| 4,522,393 | 6/1985 | Dunn | 273/1 GF |

FOREIGN PATENT DOCUMENTS

| | | | |
|---|---|---|---|
| 0190876 | 6/1986 | European Pat. Off. | 273/1 GG |
| 2260365 | 5/1975 | France | 273/264 |

*Primary Examiner*—Edward M. Coven
*Assistant Examiner*—Paul R. Harrison
*Attorney, Agent, or Firm*—Henderson & Sturm

[57] ABSTRACT

The game comprises a plurality of playing members capable of being stacked, columnar fashion, in various configurations. Each member has opposed flat surfaces for flat-wise engagement with a surface of a neighboring member and these surfaces are treated or otherwise provided as low-friction surfaces. The basic object of the game is to manually push one member rapidly from beneath an overlying member and to catch the pushed member before it falls to the playing surface. Cards are provided to designate the various types of stacked arrangements to be used in variations of the basic game. Scoring adjuncts are also provided. The playing members are provided in one set of several members configured as right parallelepipeds and another set of several members configured as low-altitude cylinders.

13 Claims, 4 Drawing Sheets

Fig. 1
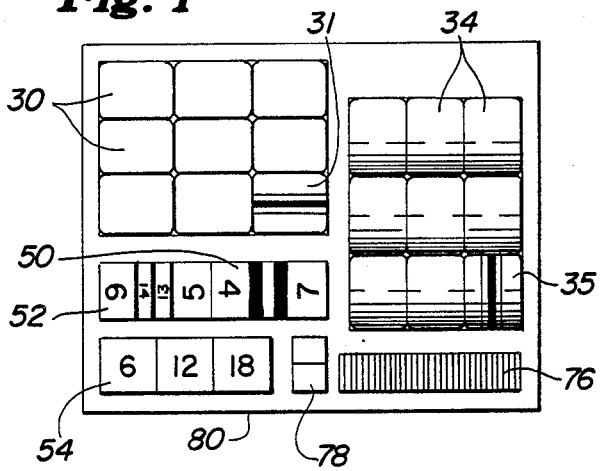
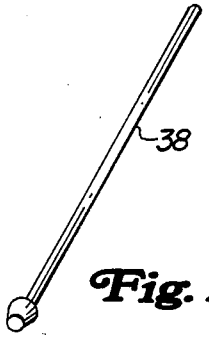
Fig. 2
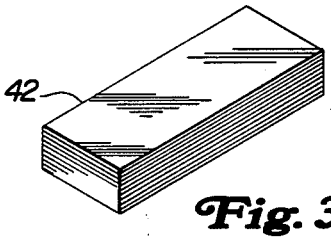
Fig. 3
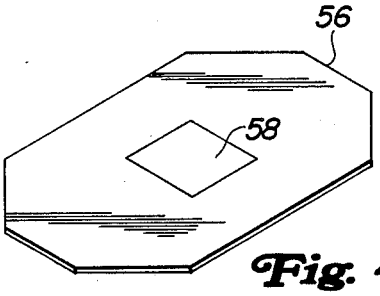
Fig. 4
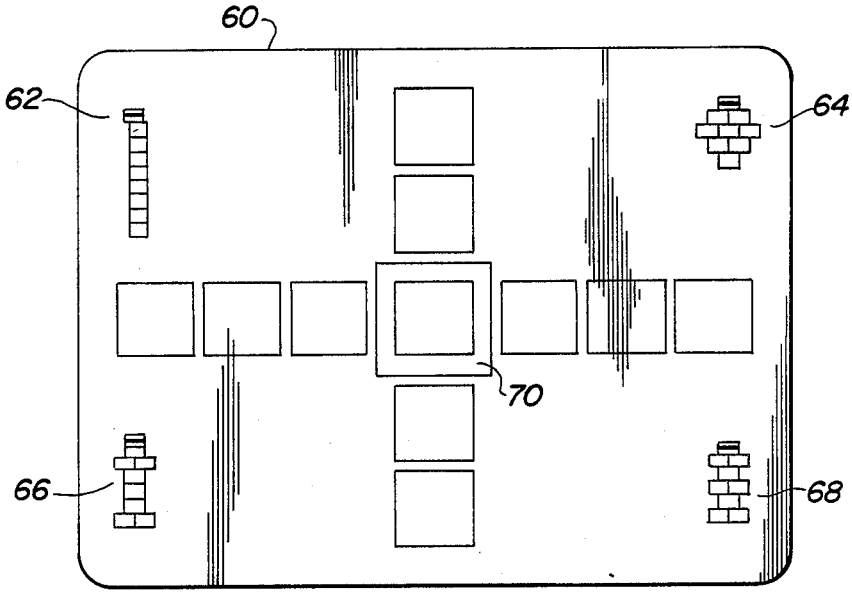
Fig. 5

STACKED ELEMENT REMOVAL GAME INCLUDING CARDS BEARING DIFFERENT STACK PATTERNS

BACKGROUND AND SUMMARY OF THE INVENTION

Various types of prior art games exist based on the principle of removing lower members of stack-type arrangements without disturbing members above the removed members. These are largely lacking in versatility and thus lead to monotony and waning interest. According to the present invention, the playing members are so constructed and related to each other as to lend themselves to a large variety of stacking configurations and thus provide increased versatility and prolonged interest in the game. One set of members includes a plurality of right parallelepipeds or blocks and another set includes low-altitude cylinders or drums. The diameter of each cylinder is greater than a side of the square surface of the parallelepipeds and the cylinder altitude is equal to the height or distance between opposed square surfaces of the parallelepipeds. A further object of the invention is to provide novel scoring adjuncts, a playing board, a playing table, cards to designate stack configurations, dice and elements representing bonus points in the scoring of the game.

Further objects and features of the invention will become apparent as a preferred embodiment of the invention is disclosed in the ensuing specification and drawings.

DESCRIPTION OF THE DRAWINGS

FIG. 1 is a plan view of the game members as contained in a storage box.

FIG. 2 is a perspective of the pusher stick or wand used for dislodging members from the stack.

FIG. 3 is a perspective of a deck of cards used in the game.

FIG. 4 is a perspective of an optional playing board.

FIG. 5 is a plan view of a further optional playing board.

DETAILED DESCRIPTION OF THE PREFERRED EMBODIMENT OF THE INVENTION

Reference will be had first to FIGS. 6, 7 and 19–25 for description of the basic playing members and stack configurations, together with the rudiments of playing a relatively simple form of the game.

Figure 6:
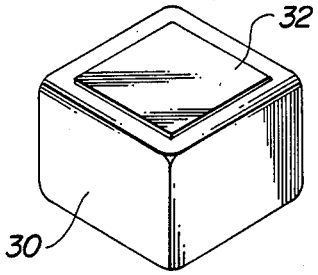
FIG. 6 is an enlarged perspective of one of the playing members configured as a right parallelepiped.

FIG. 6 shows one of the playing members having the configuration of a right parallelepiped (30), hereinafter referred to as a block. This block may be formed of any suitable material and typically is relatively light in weight, in the order of two ounces. Being a right parallelepiped, the block has upper and lower square surfaces preferably measuring one and three-quarter inches per side; the block also has four right-rectangular faces the long edges of which are the sides of the square and the short edges or altitudes of which are in the order of one and five-eighth inches. The top and bottom squares are treated in any suitable manner with low-friction material, as by a coating of finely calendered paper (32). One block, for purposes to presently appear, may be striped or have other indicia and is designated (31).

Figure 7:
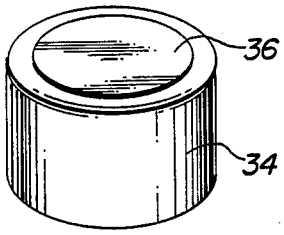
FIG. 7 is a perspective of a cylindrical playing member.
Figure 19:
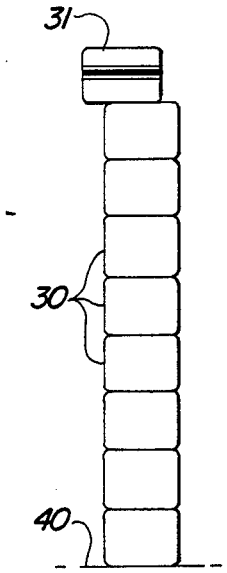
FIGS. 19–22 are elevations showing successive steps in the playing of the game.
Figure 20:
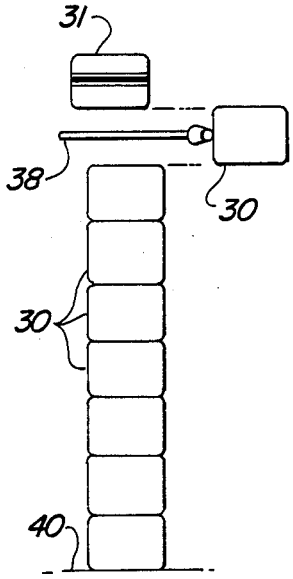
Figure 21:
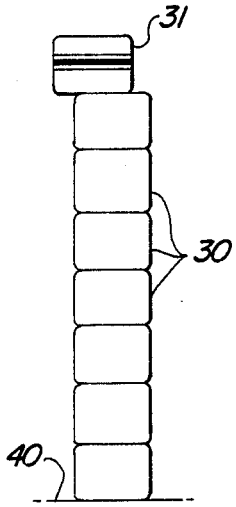
Figure 22:
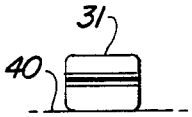
Figure 23:
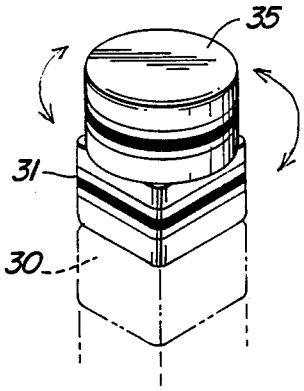
FIGS. 23–25 are perspectives illustrating different relationships of the playing members that may be used in stacking configurations.
Figure 24:
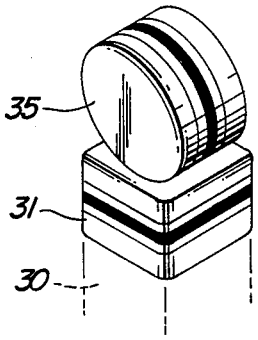
Figure 25:
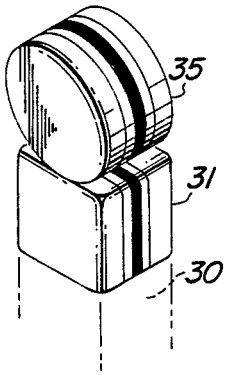

FIG. 7 shows one of the low-profile cylinders, hereinafter referred to as a drum (34), here having a diameter greater than the side of a square of the block (30); e.g., two and one-quarter inches, and an altitude of one and five-eighth inches, or equal to the altitude of a block (30). The top and bottom circular surfaces of the drum are treated to provide low-friction results, as by a paper coating or layer (36) according to that used at (32) for the blocks. Each drum weighs about two ounces, like each block. One drum, designated (35) may be striped or otherwise colored, etc, FIGS. 19–22 show selected sequences in the playing of a simple form of the game in which several blocks (30) are stacked in a column having the striped block (31) uppermost. FIG. 19 is the starting condition. The numeral (38) denotes a pusher in the form of a short rod-like member which is held in one hand of the player who uses it to dislodge a block next below the top block (31) (FIG. 20). For this purpose, the player uses a quick motion to dislodge the pushed block and he catches the pushed block in his other hand so that it does not fall to the playing surface, here indicated at (40). All this must be accomplished without causing collapse of the stack so that the top block (31) drops atop the block next below the dislodged block (FIG. 21). The game continues in this fashion until only the top block remains on the playing surface (FIG. 22). The same scheme of things may be used with stacks of drums alone or stacks of drums and blocks together. In such stacking configuration, several arrangements of block-to-drum may be used at the top of the stack (FIGS. 23–25). FIG. 23 shows a face-to-face arrangement. FIG. 24 shows an arrangement in which the drum is tangent to the square face of a block. In FIG. 25, the tangency occurs between a drum and side face of a block. As an alternative, a player may use his hand without the pusher (38) for dislodging playing members.

Figure 18:
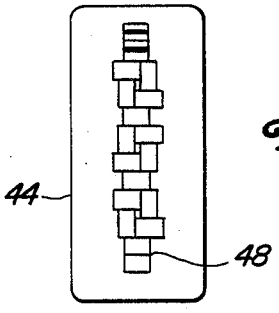
FIG. 18 is a plan view of one of the stack-designating cards.

The game includes a deck (42) (FIG. 3) containing designating cards (44) and bonus cards (46). FIG. 18 shows a representative stack card bearing indicia (48) in the form of a pictorial display of a stack configuration using both blocks and drums. If during the coarse of play, a player draws such card, the stack configuration to be used in the game is the one designated by the selected card (44). Preferably, there are thirty-two cards (44) and three cards (46). It is to be noted that the configuration designated by the card in FIG. 18 includes dual blocks and drums employing one or more of the arrangements shown in FIGS. 23–25; and some of the blocks and drums are side-by-side. In a stack configuration like this, the player may use the pusher (38) to nudge a selected block or drum to a better position for ultimate displacement, which requires a certain amount of skill and dexterity that will be developed as the player acquires experience.

Figure 8:
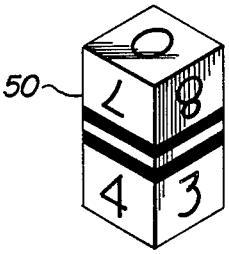
FIG. 8 is a perspective of one form of scoring element or stick.
Figure 9:
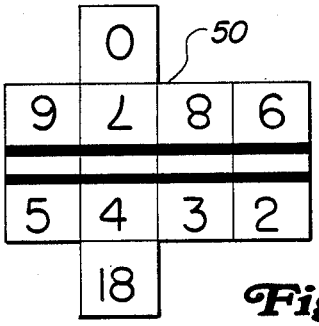
FIG. 9 is a "developed" view of the element of FIG. 8.
Figure 10:
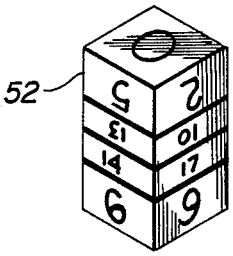
FIG. 10 is a perspective of another form of scoring stick.
Figure 11:
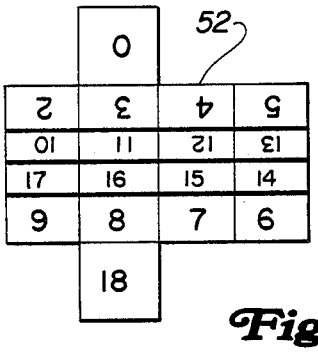
FIG. 11 is a "developed" view of the stick of FIG. 10.
Figure 12:
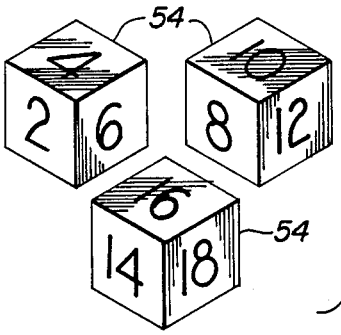
FIG. 12 is a perspective of a group of three dice used in the game.

Since the basic idea of the game, as in most games, is to score points based on selected results, the game will be made more interesting by the awarding of bonus points based on the draw of one or more of the bonus cards shown in FIGS. 14–17, which are variously numbered to reflect different scoring values. Keeping track of players' scores is facilitated by the use of scoring sticks. One form of stick (50) is shown in FIGS. 8 and 9 and another form (52) in FIGS. 10 and 11. The former is designed for use in simplified forms of the game as played by children and the latter for use by adults in advanced types of the game. In either case, each stick bears suitable numbers representing points scored, and the stick may be placed in selected positions; e.g., upright, flatwise, etc. according to the accumulated points. By way of adding further interest to the game, dice (54) (FIG. 12) may be used. As seen, one of the dice is numbered on through six, another seven through twelve and the third thirteen through eighteen. The dice may be cast singly, in twos or threes according to the particular rules or according to player agreement.

As explained in connection with FIGS. 19–22, the stacks may be supported on any suitable playing surface. FIG. 4 shows an optional playing board (56) having a central spot (58) on which the stack may be started. One advantage of the board (56) is that it may be turned on the surface on which it is supported so as to afford more advantageous positions of the stack relative to the player. This avoids the necessity for the player to walk around a table or the like on which the stack is erected, as in instances in which blocks or drums become misaligned without causing total collapse of the stack, as when dislodging of a selected block or drum causes minor lateral offsetting of one or more lower blocks or drums.

FIG. 5 shows another optional board (60) having indicia at (62), (64), (66) and (68) in the form of pictorial displays of stacks representative of stack configurations to be used. The board has further indicia (70) for designating placement of the selected stack.

Figure 13:
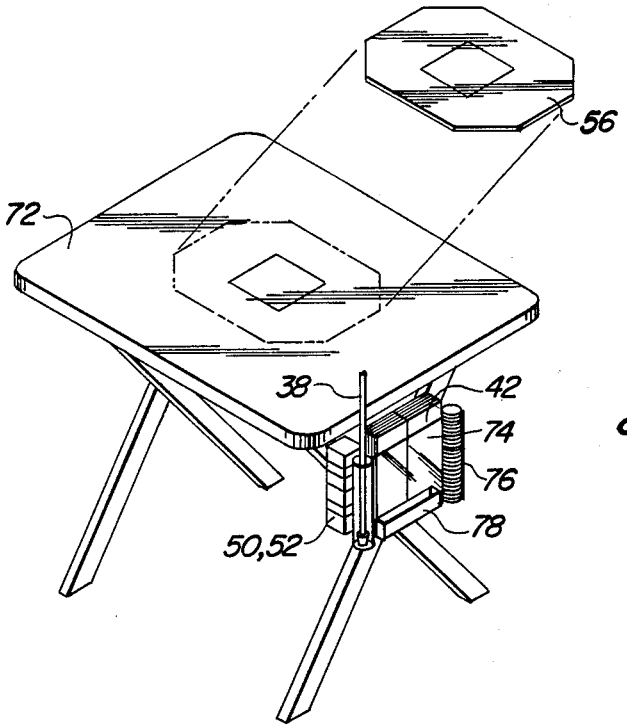
FIG. 13 is a perspective of a playing table.
Figure 14:
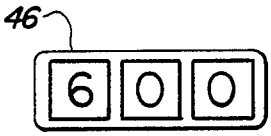
FIGS. 14–17 are plan views of bonus cards used in the game.
Figure 15:
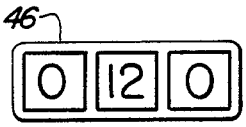
Figure 16:
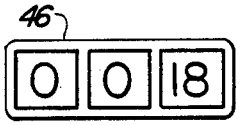
Figure 17:
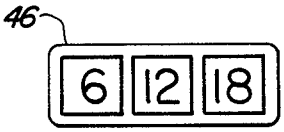

FIG. 13 illustrates a table (72) having a flat top on which the boards of FIGS. 4 or 5 can be used. The table may be of the fold-away type and is shown as carrying a pocket (74) for conveniently carrying the smaller game components. In addition to the elements and members already described, the game may include a plurality of tokens, such as typical poker chips (76). To assure that the game is free from friction-creating surfaces, accumulations, etc., one or more boxes or cans (78) of talcum powder are provided, preferably of the fine type known as baby powder, which may be used on the players' hands.

FIG. 1 shows a representative form of packaging of the basic components, comprising a box (80). In more complicated versions of the game, larger boxes may be used or otherwise to facilitate shipping, storing, etc. of the game and its parts.

As noted earlier herein, the blocks and drums are relatively light in weight and may be formed of any suitable material, preferably such that the members are resistant to nicks, scratches. The corners are smoothly rounded on small radii. The members may be vari-colored to add to the attractiveness of the game and different colors, etc. may be used to designate different scoring values. The dimensioning of the blocks as less than full cubes increases the versatility of these members, since each may occupy two different positions; i.e., on either square surface or on one of the rectangular surfaces. The relative areas of the surface on both the blocks and drums afford variety in stacking the members; e.g., two blocks may be placed on top of a "flat" drum in side-by-side relation and overlapping the drum surface, etc. and additionally retained by a superimposed block or drum. The patterns shown in FIGS. 5 and 18 will suggest various modes of stacking. FIGS. 23–25 show other modes. With a little skill, it will be found relatively easy to achieve positions such as shown in FIGS. 24 and 25 where the drums are supported tangentially on member flat surfaces. Obviously, the area of an end of a drum is greater than that of a square surface of the block. The diagonal of a square here is greater than the radius of a drum, etc.

The manner of scoring may have several variations, based on the proposition that points are awarded for successfully dislodging members according to the basic pattern represented by FIGS. 19–22. Additional points may be awarded for stacks of more complicated configurations. The use of the scoring sticks (FIGS. 8–11) involves positioning the sticks according to the point total; for example, stood on end, placed on one of the long sides in various positions, etc. In keeping with the selected sizes of the blocks and drums, the scoring sticks are preferably 3 ½" × 1 ½" × 1 ½", although these dimensions may be varied, as may of the blocks and drums but keeping in mind the ratios of surface and altitude dimensions with respect to areas, etc.

Features and advantages other than those enumerated herein will readily occurred to those versed in the art, along with variations in the rules and variations in the dimensions, shapes of the elements disclosed, all of which may be achieved without departure from the spirit and scope of the invention.

I claim:

1. A game adapted to be played on a flat playing surface, comprising a first set of playing members made up of a plurality of identical blocks of right parallelepiped configuration and a second set of playing members made up of a plurality of right cylinders, the members of both sets being adapted to be stacked in column fashion in any of several patterns; a playing board having a flat top providing the playing surface on which the playing members can be stacked; and, a set of cards bearing different indicia representitive of the different patterns in which the members can be stacked.

2. A game according to claim 1, including a hand-held pushing element by means of which selected members of a stack may be pushed laterally outwardly from below a member resting on the member to be pushed.

3. A game according to claim 2 in which the square surfaces of the blocks and the circular faces of the cylinders are provided with low-friction surfaces for facilitating lateral pushing of the members sequentially from the stack.

4. A game according to claim 2, including a score-keeping element bearing indicia representitive of the number of members a player has successfully pushed from the stack.

5. A game according to claim 4, including bonus cards for selection by chance and representing points additional to those scored by a player as a result of pushing one or members from the stack.

6. A game according to claim 4, including a plurality of tokens to be awarded to a player achieving certain results in playing the game.

7. A game according to claim 1, in which one member bears indicia designating a preselected position in the stack.

8. A game according to claim 1, including table having flat top affording the flat playing surface, and means on the table for carrying game-playing adjuncts additional to the playing members.

9. A game according to claim 1, including a playing board having a flat top providing the playing surface on which the members are stackable, said top bearing indicia representing modes in which the members are stackable.

10. A game according to claim 1, including a table and a playing board on the table providing the flat playing surface for the stacked members, and said board being selectively angularly movable about the vertical axis of the stack.

11. A game according to claim 1, including a plurality of dice variously numbered to represent scored points based on members removed laterally from the stack by a player.

12. A game according to claim 1, in which each block has opposed top and bottom square faces and four rectangular side faces, each side face including top and bottom long edges formed by top and bottom edges of the square faces and upright edges shorter than the long edges.

13. A game according to claim 12, in which each cylinder has a diameter greater than an aforesaid long edge and an altitude equal to an aforesaid short edge.

* * * * *